US007341165B2

(12) United States Patent
Tippmann

(10) Patent No.: US 7,341,165 B2
(45) Date of Patent: Mar. 11, 2008

(54) LID FOR A CONTAINER

(75) Inventor: Vincent P. Tippmann, Fort Wayne, IN (US)

(73) Assignee: Universal Lid Corporation, Fort Wayne, IN (US)

( * ) Notice: Subject to any disclaimer, the term of this patent is extended or adjusted under 35 U.S.C. 154(b) by 126 days.

(21) Appl. No.: 10/927,068

(22) Filed: Aug. 27, 2004

(65) Prior Publication Data

US 2005/0045650 A1 Mar. 3, 2005

Related U.S. Application Data

(60) Provisional application No. 60/498,646, filed on Aug. 29, 2003.

(51) Int. Cl.
*B65D 43/24* (2006.01)

(52) U.S. Cl. ..... 220/828; 220/831

(58) Field of Classification Search ..... 220/254.3, 220/254.5, 263, 264, 827, 828, 831, 832; 312/249.7, 138.1

See application file for complete search history.

(56) References Cited

U.S. PATENT DOCUMENTS 1,012,965 A * 12/1911 Bachrach ..... 312/117
2,038,218 A * 4/1936 Holt ..... 220/522
2,621,831 A 12/1952 Smith
2,641,795 A * 6/1953 James et al. ..... 16/290
2,686,340 A * 8/1954 Davis, Jr. et al. ..... 49/386
3,001,227 A 9/1961 Long et al.
3,598,276 A * 8/1971 Brown ..... 220/831
3,675,813 A 7/1972 Morgan
4,014,457 A * 3/1977 Hodge ..... 220/812
RE29,494 E * 12/1977 Hodge ..... 220/812
4,726,634 A * 2/1988 Dewees et al. ..... 312/100
D308,742 S * 6/1990 Bulkens ..... D34/11
5,600,921 A * 2/1997 Vardaro ..... 49/380

* cited by examiner

*Primary Examiner*—Anthony D. Stashick
*Assistant Examiner*—James Smalley
(74) *Attorney, Agent, or Firm*—Birch, Stewart, Kolasch & Birch, LLP

(57) ABSTRACT

A lid for a container includes a side element extending from a front of the lid to a rear of the lid. A fulcrum point is formed at one end of the side element and is disposed adjacent to a rear of the lid. A rear surface of the lid includes a portion that projects upwardly and rearwardly to a furthermost rear point that is displaced rearwardly a predetermined distance relative to the fulcrum point. A counter-balance weight is positioned on the furthermost rear point of the lid. Wherein when the lid is raised, the weight of the lid and the counter-balance weight provide a force for raising the lid and to selectively maintain the lid in an open position. When the lid is lowered, the weight of the lid and the counter-balance weight provide a force for closing the lid.

20 Claims, 2 Drawing Sheets

LID FOR A CONTAINER

CROSS-REFERENCE TO RELATED APPLICATIONS

The present application is related to U.S. Application No. 60/498,646 filed on Aug. 29, 2003 the entire contents of which are hereby incorporated by reference and priority is claimed under 35 USC 119(e).

BACKGROUND OF THE INVENTION

1. Field of the Invention

A lid for a container is provided wherein when an individual raises or opens the front of the lid, there is a force applied for lifting the lid upwardly. Similarly, when an individual pulls the lid downwardly to close the lid, there is a force applied for pulling the lid downwardly.

2. Description of Background Art

Hithertofore, containers that are utilized at a salad bar for displaying food normally include a metal or glass cover that is required to be removed to permit an individual to gain access to the food in the container. This type of cover has a problem relating to the fact that the cover must be removed and set aside to permit an individual to remove food from the container. This produces an unsatisfactory result in that the cover must be positioned somewhere on the display table during the removal of the food from the container. In addition, if the inside of the cover includes condensation from a food product positioned within the container, the moisture on the inside of the cover will soil the display table when the cover is positioned on the display table.

SUMMARY AND OBJECTS OF THE INVENTION

It is an object of the present invention to provide a lid for a container wherein the lid is pivoted about a fulcrum at a point adjacent to a rear portion of the lid to assist with the raising and holding of the lid when the lid or cover is raised to permit a consumer to gain access to a food product positioned within the container. In addition, the lid for a container of the present invention provides assistance when the lid or cover is lowered to be positioned to cover the container.

This and other objects of the present invention are achieved by providing a lid for a container that includes a side element extending from a front of the lid to a rear of the lid. A fulcrum point is formed at one end of the side element and is disposed adjacent to a rear of the lid. A rear surface of the lid includes a portion that projects upwardly and rearwardly to a furthermost rear point that is displaced rearwardly a predetermined distance relative to the fulcrum point. A counter-balance weight is positioned on the furthermost rear point of the lid. Wherein when the lid is raised, the weight of the lid and the counter-balance weight provide a force to raise the lid and to maintain the lid in an opened position. In addition, when the lid is lowered, the weight of the lid and the counter-balance weight provide a force to assist with the closing of the lid.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
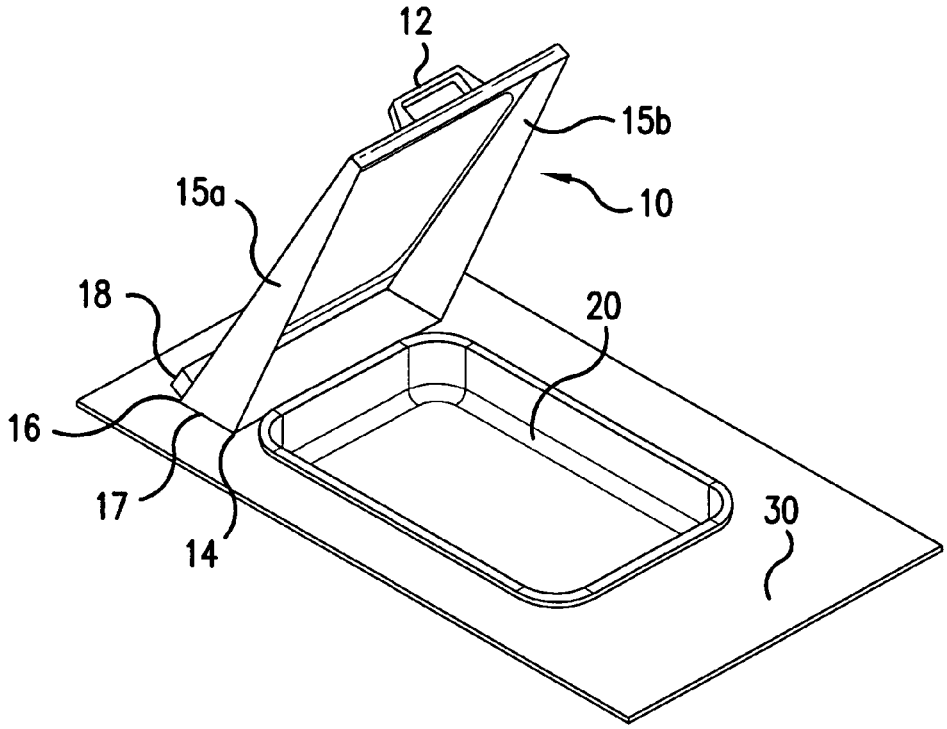
FIG. 1 is a perspective illustrating the lid for a container in an open position.

As illustrated in FIG. 1, a lid 10 for a container 20 is illustrated in a raised or open position. When the lid 10 is opened, a consumer has access to a food product or other commodity positioned within the container 20. The container 20 is mounted in an aperture formed in a display table 30. A handle 12 is provided for permitting a consumer to grip the handle 12 when raising or lowering the lid 10.

The lid 10 includes a fulcrum point 14 that is disposed adjacent to a rear portion of the lid 10. The fulcrum point 14 is an over-center point that is formed at the end of the side elements 15*a*, 15*b* of the lid 10. The rear portion of the lid 10 projects upwardly and rearwardly to a furthermost rear point 16 that is displaced rearwardly a predetermined distance relative to the fulcrum point 14. A counter-balance weight 18 is positioned on the furthermost rear point 14. The lid 10 has a fulcrum point 14 that protrudes near the rear of the lid 10 and which rests on a display table 30 to acts as a fulcrum. The height and location of the fulcrum depend on the size and weight of the lid. Once the lid 10 is opened, the lid 10 will rest on the rear surface 17 in the opened position based on the counter weight of the lid 10 and the counter-balance weight 18 which have been pivoted about the fulcrum point or over-center point 14.

Figure 2:
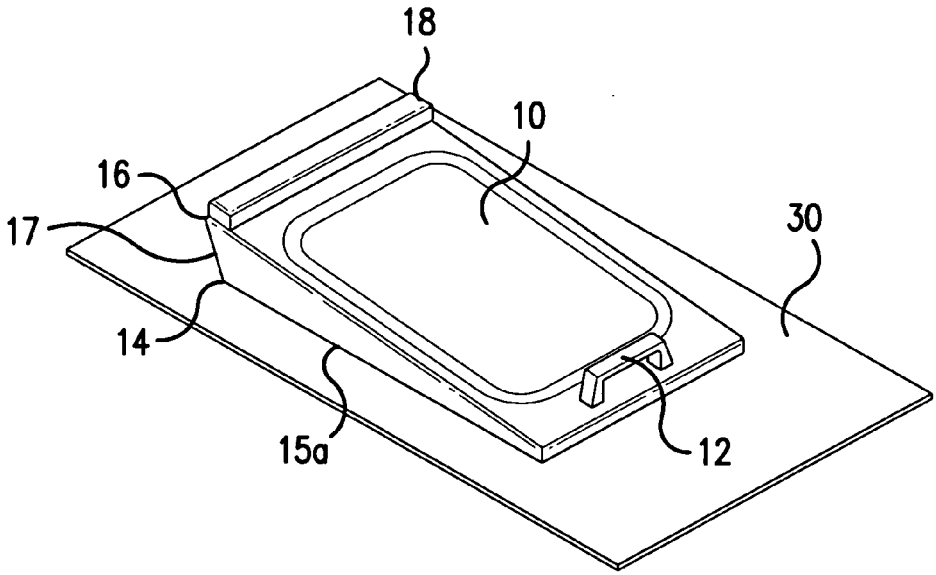
FIG. 2 is a perspective illustrating the lid for a container in a closed position.

As illustrated in FIG. 2, the fulcrum point 14 and the side elements 15*a* and 15*b* permit the lid 10 to rest on the display table 30 when the lid 10 is in a closed position. When a consumer grips the handle 12 and attempts to raise the lid 10, the counter-balance weight 18 that is attached at the back of the lid 10 behind the fulcrum or over-center point 14 acts as a counter-balance. The weight and location of the counter-balance are determined by the size and weight of the lid.

As a consumer lifts the lid 10, the center of the weight of both the lid 10 and the counter-balance weight 18 move to the back, and the front of the lid becomes lighter. Once the center of the weight goes beyond the fulcrum or over-center point, it has a tendency to pull open further or remain open if a stop is provided. As a consumer pulls the lid down, the center of the weight of the lid 10 goes in front of the fulcrum or over-center point, and the front becomes heavier and has a tendency to close the lid 10 so that the lid 10 remains closed. The weight of the lid and the counter-balance weight are such that the center of the weight for the lid and the counter-balance weight 18 is in front of the fulcrum.

More specifically, as illustrated in FIGS. 1 and 2, when the lid 10 is raised, the weight of the lid 10 functions together with the counter-balance weight 18 to move the weight of the lid and the counter-balance weight 18 past the fulcrum 14 and to the rear to facilitate the raising of the lid 10 and to maintain the lid 10 in an opened position with the lid 10 resting on the rear surface 17. In addition, the fulcrum or over-center point 14 and the counter-balance weight 18 facilitate the lowering of the lid 10 to a closed position. The handle 12 is provided to permit a consumer to grasp the handle 12 for raising or lowering the lid 10.

The present invention uses the weight of the lid 10 and the counter-balance weight 18 for opening and closing the lid 10. No spring-loaded hinges or mechanical devices are required to operate the lid 10.

As illustrated in FIGS. 1 and 2, the counter-balance weight 18 can be positioned on the exterior portion of the lid 10 for permitting the lid to be raised to an opened positioned or lowered to a closed position.

Figure 3:
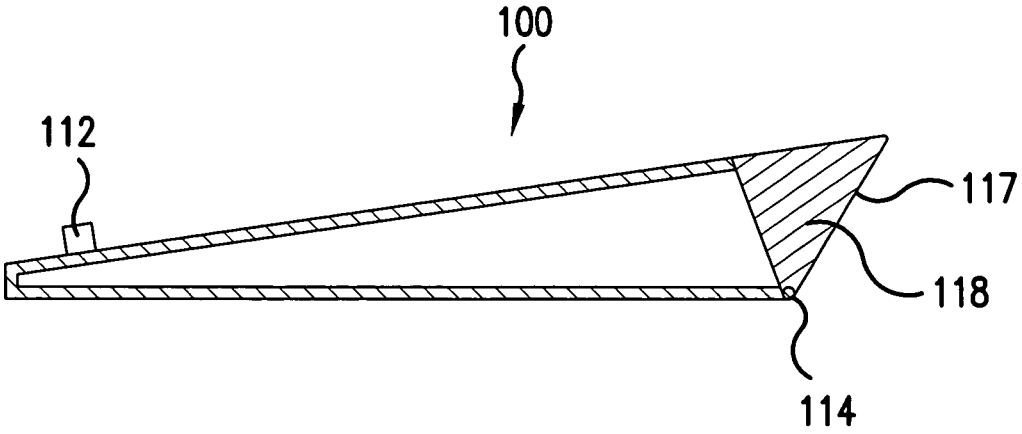
FIG. 3 is cross-sectional view of another embodiment of the lid for a container of the present invention.

FIG. 3 is a cross-sectional view wherein the counter-balance weight 118 is formed inside the rear portion of the lid 100. The rear surface 117 is disposed adjacent to the counter-balance weight 118. The fulcrum or over-center point 114 is disposed to the rear of the lid 100. The weight of the lid and the counter-balance weight are such that the center of the weight for the lid and the counter-balance weight 118 is in front of the fulcrum. Thus, the weight of the lid 100 functions together with the counter-balance weight 118 to move the weight of the lid and the counter-balance weight 118 past the fulcrum 114 to facilitate the raising of the lid and to maintain the lid in an opened position with the lid 100 resting on the rear surface 117. In addition, the fulcrum or over-center point 114 and the counter-balance weight 118 facilitate the lowering of the lid 100 to a closed position. The handle 112 is provided to permit a consumer to grasp the handle 112 for raising or lowering the lid 100.

In operation, a lid is positioned as a closure for a container on a display table or other serving area. The lid includes a first side element extending from a front of the lid to a rear of the lid. A second side element extends from the front of the lid to the rear of the lid. A cover extends between the first side element and the second side element for forming a top closure. A fulcrum point is formed at a distal end of the first side element and the second side element and is disposed adjacent to the rear of the lid. A rear surface of the lid extends between the first side element and the second side element for forming a rear closure with the rear surface projecting upwardly and rearwardly from the fulcrum point to a furthermost rear point that is displaced rearwardly a predetermined distance relative to the fulcrum point. A counter-balance weight is positioned at a point displaced from the fulcrum point towards the furthermost rear point of said lid. The weight of the lid and the counter-balance weight are such that the center of the weight for the lid is in front of the fulcrum. Thus, when the lid is raised, the weight of the lid and the counter-balance weight provide a force to raise the lid and to selectively maintain the lid in an opened position if the rear surface of the lid engages the display table or other serving area. In addition, when the lid is lowered, the weight of the lid and the counter-balance weight provide a force for closing the lid.

The shape of the lid 10, 100 in the drawings is illustrated to be substantially rectangular. The present invention is not limited to any particular shape. The shape of the lid 10, 100 can be rectangular, square, circular, triangular etc. depending of the configuration of the container to be covered.

It is to be understood that the cover 10 of the present invention may be readily removed and taken to a kitchen for cleaning. In addition, the cover 10 may include a viewing window constructed of glass or plastic to permit a consumer to see a food product positioned within the container 20. Further, the cover 10 may be used not only in connection with salad bars but also with chafing dishes, hot food lines, preparation tables, etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A hingeless lid for use on a surface and adapted to be used as a closure comprising:

a side element extending from a front of the lid to a rear of the lid;

a fulcrum point formed at one end of the side element and disposed adjacent to a rear of the lid;

a rear surface of the lid projects upwardly and rearwardly to a furthermost rear point that is displaced rearwardly a predetermined distance relative to the fulcrum point; and a counter-balance weight positioned on the furthermost rear point of said lid;

wherein when the lid is raised, the weight of the lid and the counter-balance weight provide a force to raise the lid wherein the rear surface of the lid engages the surface to selectively maintain the lid in an opened position and when the lid is lowered, the weight of the lid and the counter-balance weight provide a force to close the lid, wherein the furthermost rear portion of the lid is rearwardly with respect to the fulcurm in the opened and closed positions and the front of the lid is forward with respect to the fulcrum in the opened and closed positions.

2. The hingeless lid according to claim 1, wherein the center of the counter-balance weight is to the rear of the fulcrum point.

3. The hingeless lid according to claim 1, wherein the rear surface of the lid is disposed at an angle that forms the resting surface when the lid, is in the open position.

4. The hingeless lid according to claim 1, wherein the counter-balance weight extends a predetermined distance along the furthermost rear portion of the lid.

5. The hingeless lid according to claim 4, wherein the counter-balance weight extends substantially the entire distance along the furthermost rear portion of the lid.

6. The hingeless lid according to claim 1, and further including a handle operatively connected to the lid to assist with the raising and lowering of the lid.

7. The hingeless lid according to claim 1, wherein the counter-balance weight is positioned within the lid to assist with the raising and lowering of the lid.

8. A hingeless lid for use on a surface and adapted to be used as a closure comprising:

a first side element extending from a front of the lid to a rear of the lid;

a second side element extending from the front of the lid to the rear of the lid;

a fulcrum point formed at a distal end of the first side element and the second side element and being disposed adjacent to the rear of the lid;

a rear surface of the lid extends between the first side element and the second side element and includes a portion that projects upwardly and rearwardly to a furthermost rear point that is displaced rearwardly a predetermined distance relative to the fulcrum point; and a counter-balance weight positioned adjacent to the furthermost rear point of said lid;

wherein when the lid is raised, the weight of the lid and the counter-balance weight provide a force to raise the lid wherein the rear surface of the lid engages the surface to selectively maintain the lid in an opened position and when the lid is lowered, the weight of the lid and the counter-balance weight provide a force to close the lid, wherein the furthermost rear portion of the lid is rearwardly with respect to the fulcurm in the opened and closed positions and the front of the lid is forward with respect to the fulcrum in the opened and closed positions.

9. The hingeless lid according to claim 8, wherein the center of the counter-balance weight is to the rear of the fulcrum point.

10. The hingeless lid according to claim 8, wherein the rear surface of the lid is disposed at an angle that forms the resting surface when the lid is in the open position.

11. The hingeless lid according to claim 8, wherein the counter-balance weight extends a predetermined distance along the furthermost rear portion of the lid.

12. The hingeless lid according to claim 11, wherein the counter-balance weight extends substantially the entire distance along the furthermost rear portion of the lid.

13. The hingeless lid according to claim 8, and further including a handle operatively connected to the lid to assist with the raising and lowering of the lid.

14. The hingeless lid according to claim 8, wherein the counter-balance weight is positioned within the lid to assist with the raising and lowering of the lid.

15. A hingeless lid for use on a surface and adapted to be used as a closure comprising:

a first side element extending from a front of the lid to a rear of the lid;

a second side element extending from the front of the lid to the rear of the lid;

a cover extending between the first side element and the second side element for forming a top closure;

a fulcrum point formed at a distal end of the first side element and the second side element and being disposed adjacent to the rear of the lid;

a rear surface of the lid extending between the first side element and the second side element for forming a rear closure, said rear surface projecting upwardly and rearwardly from the fulcrum point to a furthermost rear point that is displaced rearwardly a predetermined distance relative to the fulcrum point; and a counter-balance weight positioned at a point displaced from the fulcrum point towards the furthermost rear point of said lid;

wherein when the lid is raised, the weight of the lid and the counter-balance weight provide a force to raise the lid wherein the rear surface of the lid engages the surface to selectively maintain the lid in an opened position and when the lid is lowered, the weight of the lid and the counter-balance weight provide a force to close the lid, wherein the furthermost rear portion of the lid is rearwardly with respect to the fulcurm in the opened and closed positions and the front of the lid is forward with respect to the fulcrum in the opened and closed positions.

16. The hingeless lid according to claim 15, wherein the center of the counter-balance weight is to the rear of the fulcrum point.

17. The hingeless lid according to claim 15, wherein the rear surface of the lid is disposed at an angle that forms the resting surface when the lid is in the open position.

18. The hingeless lid, according to claim 15, wherein the counter-balance weight extends a predetermined distance along the furthermost rear portion of the lid.

19. The hingeless lid according to claim 18, wherein the counter-balance weight extends substantially the entire distance along the furthermost rear portion of the lid.

20. The hingeless lid according to claim 15, wherein the counter-balance weight is positioned within the lid to assist with the raising and lowering of the lid.

* * * * *